US006021680A

United States Patent [19]

Inagaki et al.

[11] Patent Number: 6,021,680

[45] Date of Patent: Feb. 8, 2000

[54] PIPETTE

[75] Inventors: Isao Inagaki, Gifu; Akira Tsuji, Osaka; Kiyoto Shigematsu; Kazumitsu Ohga, both of Tokyo; Yoshiyuki Sunaga; Fumio Kobayashi, both of Kiryu, all of Japan

[73] Assignees: The Sailor Pen Co., Ltd, Tokyo; Itochu Corporation, Osaka, both of Japan

[21] Appl. No.: 08/989,775

[22] Filed: Dec. 12, 1997

[51] Int. Cl.[7] ..... B01L 3/02

[52] U.S. Cl. ..... 73/864.17; 73/864.01; 73/864.13

[58] Field of Search ..... 73/864.01, 864.13, 73/864.14, 864.16, 864.17, 864.18

[56] References Cited

U.S. PATENT DOCUMENTS

| | | | |
|---|---|---|---|
| 4,036,064 | 7/1977 | Hydo | 73/425.6 |
| 5,413,006 | 5/1995 | D'Autry | 73/864.18 |
| 5,435,197 | 7/1995 | Telimaa et al. | 73/864.14 |

FOREIGN PATENT DOCUMENTS

| | | |
|---|---|---|
| 62-34587 | 9/1987 | Japan . |
| 6-23283 | 2/1994 | Japan . |
| 6-210188 | 8/1994 | Japan . |
| 8-313403 | 11/1996 | Japan . |

*Primary Examiner*—Hezron Williams
*Assistant Examiner*—Thuy Vinh Tran
*Attorney, Agent, or Firm*—Sixbey, Friedman, Leedom & Ferguson, PC; Eric J. Robinson

[57] ABSTRACT

A cylinder 3 in a casing 2 is provided with a first suction chamber 34 and a nozzle part 33 having a suction passage 3*d* in communication with the first suction chamber 34. In the casing 2. a first piston 4 which is slidably inserted into the first suction chamber 34 and includes a second suction chamber 43 is provided with pushed in a direction of protruding from the first suction chamber 34. Further, in the casing 2, a second piston 5 slidably inserted into the second suction chamber 43 is provided with pushed with less resiliency than with respect to the first piston 4 in a direction of protruding from the second suction chamber 43. At the top part of the casing 2, an operating lever 6 is provided for operating the first and second pistons 4 and 5 to switch between a small suction position that the second piston 5 is embedded in the first piston 4 and a large suction position that the first and second pistons 4 and 5 are embedded in the cylinder 3 and the first piston 4, respectively.

5 Claims, 12 Drawing Sheets

PIPETTE

BACKGROUND OF THE INVENTION

This invention relates to a pipette used for transferring a specified amount of liquid from one vessel into another vessel.

A pipette is generally used, for example, when a sample of liquid for test is transferred from a vessel for sample picking into a vessel for test. As a pipette of such kind, there is known one which has a small-diameter nozzle formed at the tip end of a body vessel and a suction chamber formed in a middle part of the body vessel.

The nozzle is put in a liquid in the vessel for sample picking with the suction chamber compressed, and the suction chamber is then reduced in pressure so that the pipette sucks a liquid sample. Thereafter, the nozzle is inserted into the vessel for test, and the suction chamber is then compressed again so that the pipette discharges the sucked liquid sample into the vessel for test, thereby transferring the liquid sample to the vessel for test.

The above-mentioned conventional pipette is a fixed-capacity type one that the amount of a single suction of liquid sample is fixed and therefore its range of use is limited, which invites poor versatility. For example, when urine is examined in a physical checkup or the like, picked urine is centrifuged, the supernatant fluid is then removed and 200 $\mu$l of liquid is sampled. Thereafter, 200 $\mu$l of liquid sample and the residue are mixed and from the mixture, 15 $\mu$l of liquid sample for urine precipitation test is picked up. Thus, since the amount of suction of the conventional pipette is fixed, 200 $\mu$l of sampling and 15 $\mu$l of sampling cannot be readily switched, resulting in much expense in time and effort.

To cope with this, there is proposed a variable-capacity type pipette which is variable in sampling amount. However, although the pipette of this type has general versatility, it requires to set the sampling amount, which makes its operation inconvenient. In detail, in many cases, an operator executes sampling while holding the pipette with one hand. Therefore, when the pipette is held with one hand and the setting of the sampling amount is made with the other hand, both the hands are occupied, which makes prompt test execution difficult.

Further, since the variable-capacity type pipette has a complicated structure, this invites increase in number of parts and increase in cost.

The present invention has been made in view of the foregoing problems and therefore has its object of providing a pipette which is capable of selection between a large amount of sampling and a small amount of sampling and achieves a simple structure and a low cost.

SUMMARY OF THE INVENTION

To attain the above object, a measure taken in the invention is to two-deep fit first and second pistons into a single cylinder so that selection can be made between a large amount of sampling and a small amount of sampling by shifting the positions of both the pistons.

More specifically, as shown in FIG. 1, in a first solution of the invention, a cylinder is formed at an inner tip end of a cylindrical casing. The cylinder includes a first suction chamber open on an inward end surface of the cylinder, and a nozzle part which is formed at an outward end of the cylinder to extend to the outside of the casing and has a suction passage in communication with the first suction chamber.

Further, in the casing, there is provided a first piston which is reciprocatably inserted into the first suction chamber, comes into sliding contact with the cylinder in a gas-tight manner and is pushed in a direction of protruding from the first suction chamber by a first resilient member. The first piston includes a second suction chamber open on both end surfaces of the first piston.

Furthermore, in the casing, there is provided a second piston which is reciprocatably inserted into the second suction chamber, comes into sliding contact with the first piston in a gas-tight manner and is pushed in a direction of protruding from the second suction chamber by a second resilient member having less resiliency than the first resilient member.

In addition, at a top part of the casing, there is provided an operating lever which is movable along the axis of the casing, comes into contact at an inward end thereof with the top surface of the second piston, has a push part formed at an outward end thereof, and operates the first and second pistons to switch between a small suction position that the second piston is embedded in the first piston and a large suction position that the first and second pistons are embedded in the cylinder and the first piston, respectively.

In a second solution of the invention, the operating lever of the first solution includes a rotor in contact with the top surface of the second piston and the rotor has a plurality of slide parts extending along the axis of the casing. Further, the operating lever includes a guide member placed in the top part of the casing in a manner coaxial with the rotor, and the guide member has a plurality of slide grooves for allowing entry and exit of the slide parts. Furthermore, the operating lever includes a knocking member positioned coaxially with the rotor, and the knocking member has a plurality of cams which are each located in the corresponding slide groove and are each capable of contact with the end of the corresponding slide part. Further, the operating lever includes a knocking cover formed in a coaxial and continuous manner with the knocking member, and the knocking cover has the integrally-formed push part and moves the rotor through the cams in an axial direction of the casing. The small suction position is set in a position that the slide parts are moved out of the slide grooves.

A third solution of the invention is so composed that in the solution of claim 1 or 2, an extension nozzle is detachably attached to the tip end of the nozzle part, an annular stroking member is axially movably provided on the nozzle part in a manner capable of meeting the base end of the extension nozzle, a resilient member for pushing the stroking member in a direction of locating away from the tip end of the nozzle part is interposed between the stroking member and a tip-end cap of the casing, and detaching means for moving the stroking member to detach the extension nozzle from the nozzle part is provided.

According to the above-mentioned solutions of the invention, initially, the first piston protrudes from the cylinder and the second piston protrudes from the first piston. In the state that the first and second pistons protrude at the maximum, the operating lever is pushed. At this time, in the third solution, the extension nozzle is fitted on the nozzle part so as to be attached to the cylinder. Then, the casing is held with one hand of an operator and the push part of the operating lever is pushed with a thumb of the hand.

More specifically, in the second solution, when the knocking cover is pushed down, the knocking member moves downward so that the slide parts in contact with the cams are pushed down, thereby moving the rotor downward. When the rotor moves downward, the second piston is pushed down. At this time, since the resiliency of the first resilient member is set smaller than that of the second resilient member, the second piston is first inserted into the second suction chamber. As a result, the capacity of the second suction chamber is reduced.

When the knocking cover is further pushed down, the slide parts of the rotor exits from the slide grooves of the guide member. Then, the slide parts slide on the surfaces of the cams so that the rotor slightly rotates. At the position that the rotor has slightly rotated, the second piston is made largely inserted into the second suction chamber so that the second piston is set in the small suction position for sampling a small amount of liquid.

When the knocking cover is still further pushed down, the shaft of the knocking member comes into contact with the slide parts and in this state the rotor is moved downward so that the second piston pushes the first piston downward, thereby inserting the first piston into the first suction chamber. As a result, the capacity of the first suction chamber is reduced. Then, when the knocking cover is pushed down to the deepest position, the first piston is made most inserted into the first suction chamber so that the first piston is set in the large suction position for sampling a large amount of liquid.

In this manner, at the push of the operating lever, a small amount of sampling and a large amount of sampling are selectively executed.

According to the present invention, since the first and second pistons are two-deep fitted into the cylinder and are reciprocated, selection can be made between a large amount of sampling and a small amount of sampling. As a result, the pipette of the present invention extends the range of applications as compared with the conventional pipette whose sampling amount is limited to a fixed amount. In particular, when a large number of samples are tested, a necessary amount of sampling can be readily made, which achieves prompt test execution.

Further, since the pipette of the present invention can simplify the structure and reduce the number of parts as compared with the conventional pipette of the capacity-variable type whose sampling amount is arbitrarily set, this reduces the manufacturing cost.

According to the second solution of the invention, selection between a small amount of sampling and a large amount of sampling can be made with one hand, i.e., at the push of the push part by a thumb. As a result, operation can be simplified thereby speeding the execution of various kinds of tests.

According to the third solution of the invention, the extension nozzle can be detached through the operation of the detaching means alone. As a result, samples are avoided from touch with hand, which enables the test or the like to be executed in a prompt and considerably sanitary manner.

BRIEF DESCRIPTION OF THE DRAWINGS

FIG. 6 is an exploded perspective view showing a cylinder, a first piston, a second piston and so on.

DESCRIPTION OF THE PREFERRED EMBODIMENT

Figure 1:
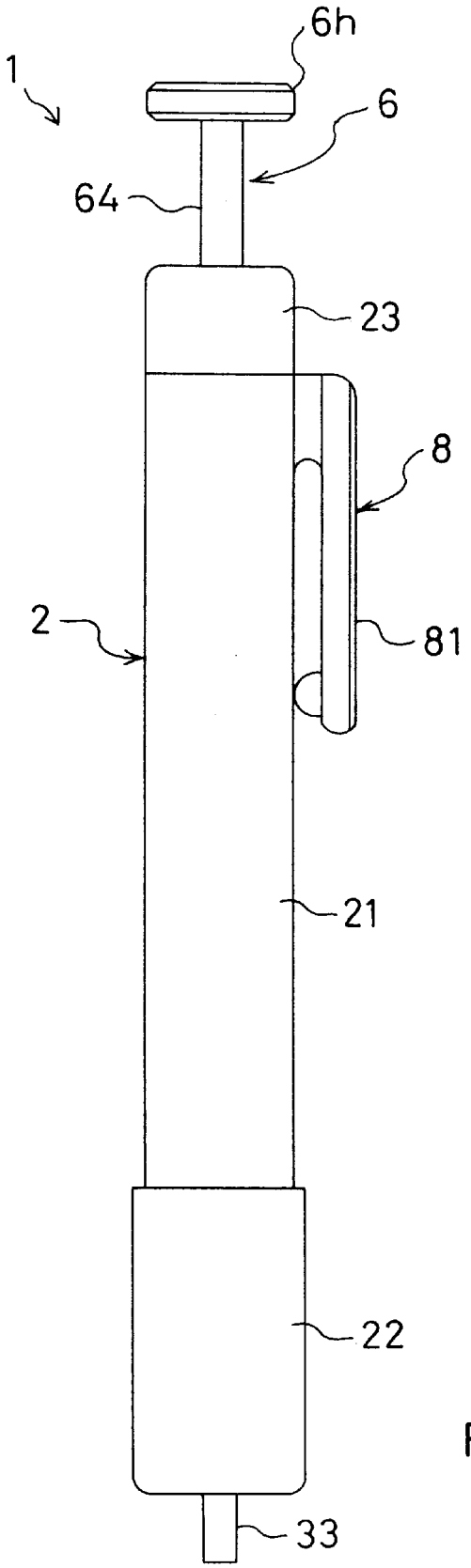
FIG. 1 is a front view showing a pipette of the present invention.

Description will be made below about an embodiment of the present invention with reference to the drawings.

General Construction

As shown in FIGS. 1 to 5, a pipette 1 is for transferring various kinds of liquid samples from one vessel to another vessel. The pipette 1 is so composed that a cylinder 3, a first piston 4, a second piston 5, an operating lever 6 and so on are housed in a casing 2 and selection can be made between a large amount of sampling and a small amount of sampling.

The casing 2 has a cylindrically shaped body part 21. The body part 21 is screwed at the tip end thereof into a tip-end cap 22 and at the top thereof into a head cap 23. The body part 21 is formed in a through-type cylinder whose both end surfaces are open. In the body part 21, a large-diameter hole 24 on the tip end side and a small-diameter hole 25 on the top side are continuously formed via a step.

Figure 6:
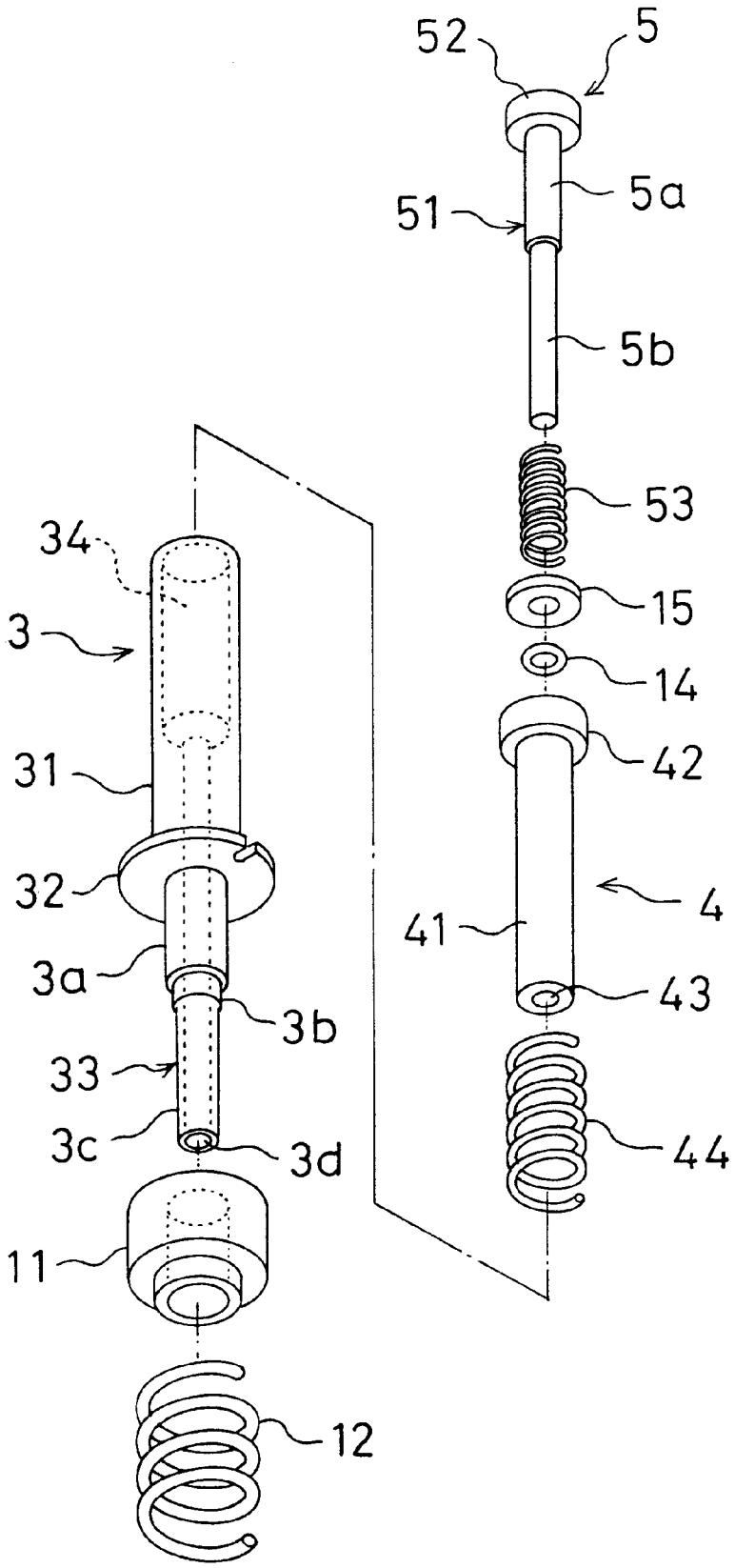

Also as shown in an exploded perspective view of FIG. 6, the cylinder 3 is so composed that a flange 32 is formed at the tip end of a cylinder body 31 and a nozzle part 33 is integrally formed at the tip end of the cylinder body 31. The cylinder body 31 is inserted into the body part 21 of the casing 2 from the large-diameter hole 24 and the flange 32 is formed so as to have a diameter as large as the tip end surface of the body part 21 and come into contact with it. Further, the cylinder body 31 is internally provided with a first suction chamber 34 open on an inward end surface thereof located at the upper end in FIG. 3.

The nozzle part 33 is formed continuously with the cylinder body 31 so as to protrude from the flange 32 toward the tip end of the casing 2 and passes through an opening 2*a* of the tip-end cap 22. In the nozzle part 33, a large-diameter base end part 3*a*, an intermediate part 3*b* having a smaller diameter than the base end part 3*a* and a tip end part 3*c* having a smaller diameter than the intermediate part 3*b* are continuously formed from the flange 32 side. Further, the nozzle part 33 is internally provided with a suction passage 3*d* in communication with the first suction chamber 34 and the suction passage 3*d* is open on the tip end surface of the nozzle part 33.

Figure 8:
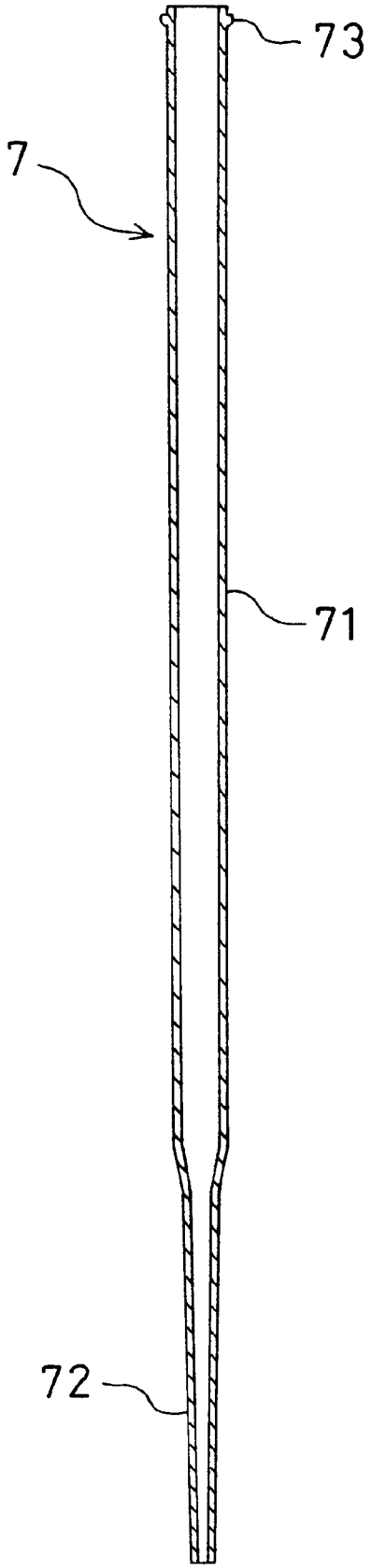
FIG. 8 is a vertical cross section showing an extension nozzle.

As shown in FIG. 8, an extension nozzle 7 is attachable to the nozzle part 33. The extension nozzle 7 is a small-diameter cylinder and has an extension part 71 and a tapered part 72 formed continuously with the extension part 71. The intermediate part 3*b* of the nozzle part 33 is fitted into the end of the extension part 71. On the outer periphery of the end of the extension part 71, an annular projection 73 having a slightly larger diameter than the base end part 3*a* of the nozzle part 33 is formed.

An annular stroking member 11 is axially movably attached to the base end part 3*a* of the nozzle part 33. Between the stroking member 11 and the tip-end cap 22, a compression spring 12 as a resilient member is interposed. The stroking member 11 is pushed in a direction of locating away from the tip end of the nozzle part 33 and is pressed against the flange 32. When the stroking member 11 is moved toward the tip end of the nozzle part 33 by a detaching means 8, it meets the projection 73 of the extension nozzle 7 and acts to detach the extension nozzle 7 from the nozzle part 33.

The first piston 4 is so composed that a cylindrical piston body 41 and a flange 42 at one end of the piston body 41 are formed in one piece. An inner space of the first piston 4 is formed into a second suction chamber 43 whose both end surfaces are open. The piston body 41 is reciprocatably inserted into the first suction chamber 34 and comes into sliding contact with the cylinder 3 in a gas-tight manner through a annular sealing 13. The flange 42 has a diameter capable of sliding contact with the large-diameter hole 24 of the casing 2. Between the flange 42 and the cylinder body 31, a first spring 44 as a first resilient member is interposed. Thus, the first piston 4 is pushed in a direction of protruding from the first suction chamber 34. Further, the flange 42 is brought into contact with the surface of the step between the large-diameter hole 24 and the small-diameter hole 25 of the body part 21 so that the first piston 4 is kept in its maximum protruding position.

The second piston 5 is so composed that a bar-shaped piston body 51 and a flange 52 at one end of the piston body 51 are formed in one piece. The piston body 51 consists of a large-diameter part 5*a* and a small-diameter part 5*b*. The small-diameter part 5*b* of the piston body 51 is reciprocatably inserted into the second suction chamber 43 and comes into sliding contact with the first piston 4 in a gas-tight manner through an annular sealing 14. The large-diameter part 5*a* is formed so as to be capable of meeting the flange 42 of the first piston 4.

The flange 52 has a diameter capable of sliding contact with the small-diameter hole 25 of the casing 2. Between the flange 52 and the flange 42 of the first piston 4, a second spring 53 as a second resilient member is interposed. Thus, the second piston 5 is pushed in a direction of protruding from the second suction chamber 43. Further, the flange 52 is brought into contact with the operating lever 6 and the second piston 5 is kept in its maximum protruding position by the second spring 53. As a feature of the present invention, the second spring 53 is set to have less resiliency than the first spring 44. Between the second spring 53 and the flange 42 of the first piston 4, a holding member 15 for holding the annular sealing 14 is interposed.

Figure 7:
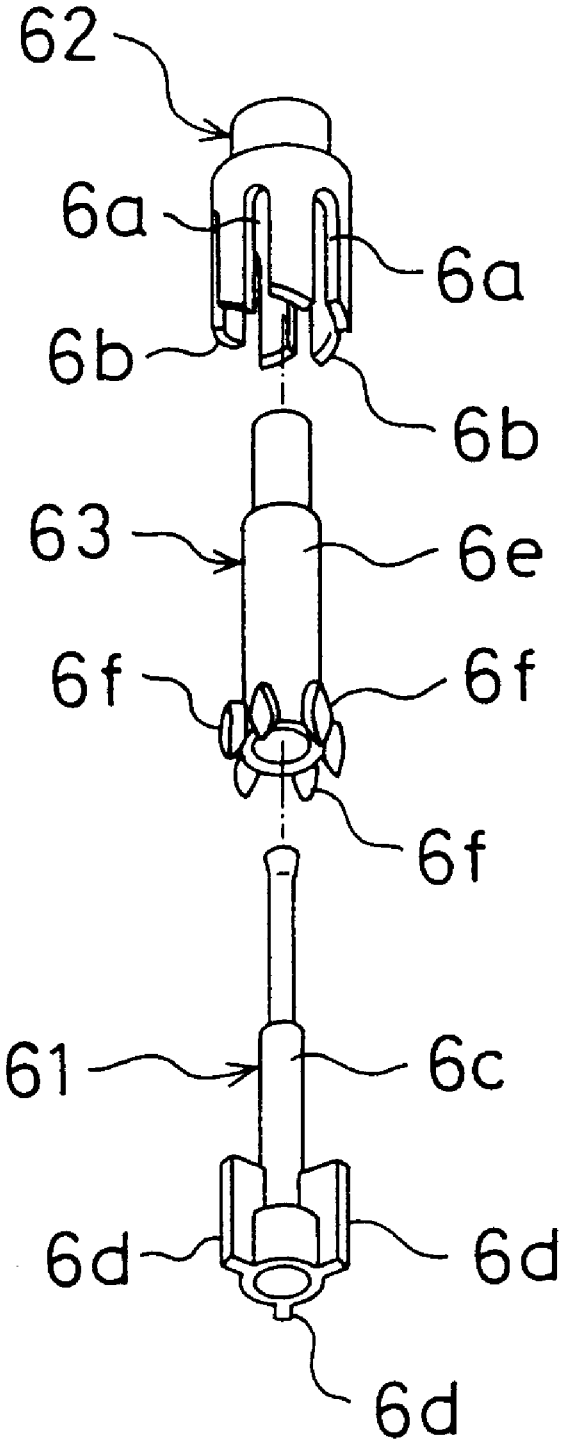
FIG. 7 is an exploded perspective view showing an operating lever.

As shown in FIG. 7, the operating lever 6 includes a knocking mechanism and the knocking mechanism is formed of a rotor 61, a guide member 62, a knocking member 63 and a knocking cover 64. The operating lever 6 is provided movably along the axis of the casing 2 so as to operate the first and second pistons 4 and 5 to switch between a small suction position that the second piston 5 is embedded in the first piston 4 and a large suction position that the first and second pistons 4 and 5 are embedded in the cylinder 3 and the first piston 4, respectively.

The guide member 62 is formed in an approximately cylindrical shape, is fixedly fitted in the top part of the small-diameter hole 25 of the body part 21 of the casing 2, and has a plurality of slide grooves 6*a*, 6*a*, . . . . The plurality of, for example, six slide grooves 6*a*, 6*a*, . . . are each opened at one end thereof (lower end of FIG. 7). Strips 6*b*, 6*b*, . . . between the adjacent slide grooves 6*a*, 6*a*, . . . are each formed such that a bottom surface thereof is inclined from one slide groove 6*a* toward the adjacent slide groove 6*a*.

At one end (lower end of FIG. 7) of a small-diameter shaft part 6*c* of the rotor 61, a plurality of slide parts 6*d*, 6*d*, . . . extending in an axial direction are formed integrally with the shaft part 6*c*. The rotor 61 is so formed that the bottom surface thereof comes into contact with the flange 52 of the second piston 5 and the shaft part 6*c* coaxially passes through the guide member 62. The slide parts 6*d*, 6*d*, . . . are provided by the half number of slide grooves 6*a*, 6*a*, . . . , for example, by three. Further, the slide parts 6*d*, 6*d*, . . . have inclined top surfaces corresponding to the inclined bottom surfaces of the strips 6*b*, 6*b*, . . . , respectively, so as to be capable of entering and exiting from the slide grooves 6*a*, 6*a*, . . . .

The knocking member 63 is so composed that a cylindrical shaft part 6*e* and a plurality of cams 6*f*, 6*f*, . . . in approximately elliptical shape located at one end (lower end of FIG. 7) of the shaft part 6*e* are formed in one piece. The shaft part 6*e* coaxially passes through the guide member 62 and the shaft part 6*c* of the rotor 61 is inserted into the shaft part 6*e*. The cams 6*f*, 6*f*, . . . are provided by the number corresponding to the number of slide grooves 6*a*, 6*a*, . . . , for example, by six, and are positioned in the slide grooves 6*a*, 6*a*, . . . , respectively. Half of the cams 6*f*, 6*f*, . . . come into contact with the slide parts 6*d*, 6*d*, . . . , respectively.

The knocking cover 64 is so composed that a shaft part 6*g* and a disk-shaped push part 6*h* at one end (upper end of FIG. 4) of the shaft part 6*g* are formed in one piece. The lower end of the shaft part 6*g* passes through the head cap 23 of the casing 2 and is fitted on the shaft part 6*e* of the knocking member 63, so that the knocking cover 64 is provided coaxially with the knocking member 63. When the knocking cover 64 is pushed, the cams 6*f*, 6*f*, . . . push the slide parts 6*d*, 6*d*, . . . downward. Then, when the slide parts 6*d*, 6*d*, . . . exit from the slide grooves 6*a*, 6*a*, . . . , the rotor 61 rotates and the second piston 5 is set in the small suction position.

The detaching means 8 is composed of a clip 81 and a detaching pin 82. The clip 81 is slidably provided in a mounting groove 2*b* axially formed on the top part of the body part 21 of the casing 2. The detaching pin 82 is inserted into the body part 21 of the casing 2 so as to pass through the body part 21. The detaching means 8 is so composed that when the clip 81 is pushed down from the position of FIG. 2, the detaching pin 82 moves downward and passes through the flange 32 of the cylinder 3 to push the stroking member 11 downward, thereby detaching the extension nozzle 7.

Sampling

Next, a description will be given to the sampling of a liquid for test with the use of the above-mentioned pipette 1.

Figure 2:
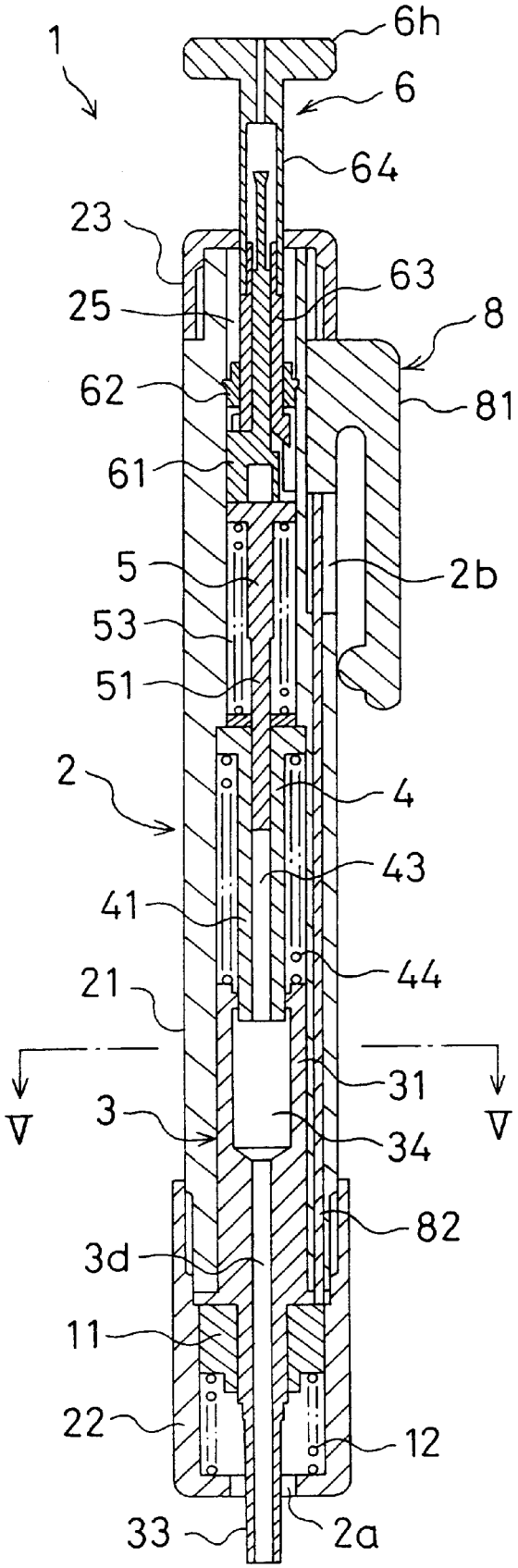
FIG. 2 is a vertical cross section showing the pipette.
Figure 3:
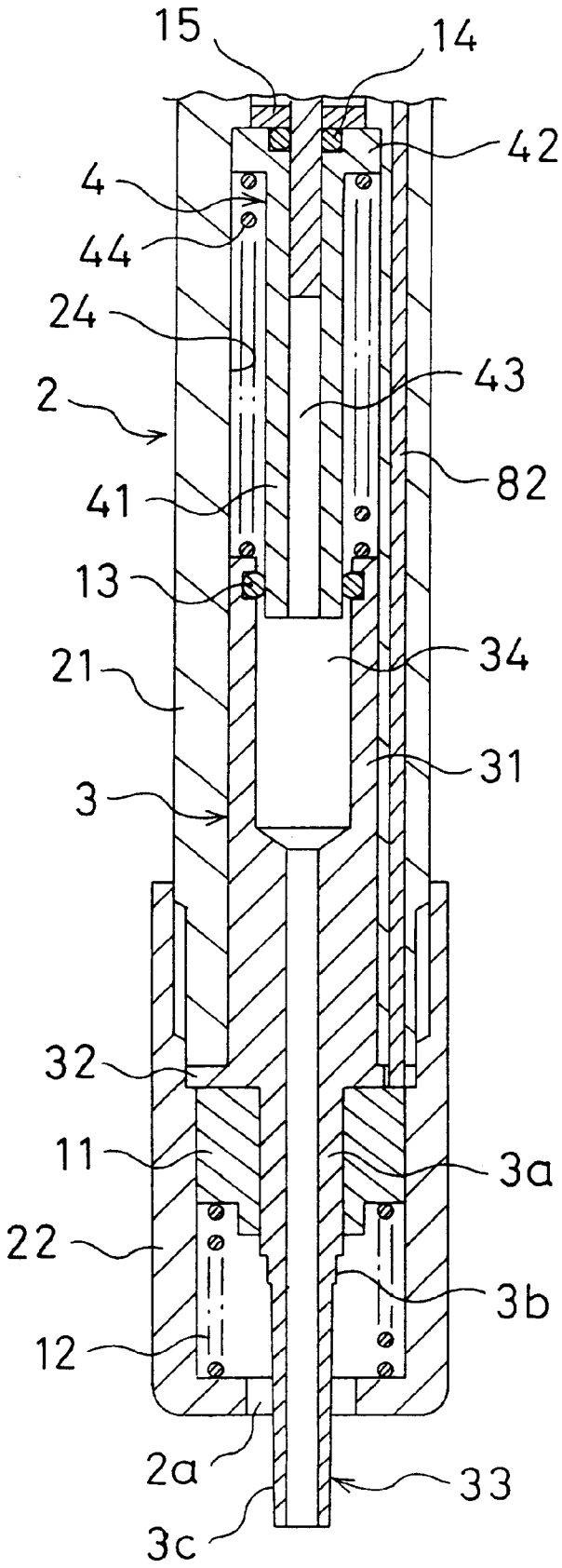
FIG. 3 is an enlarged vertical cross section showing the tip end side portion of the pipette.
Figure 4:
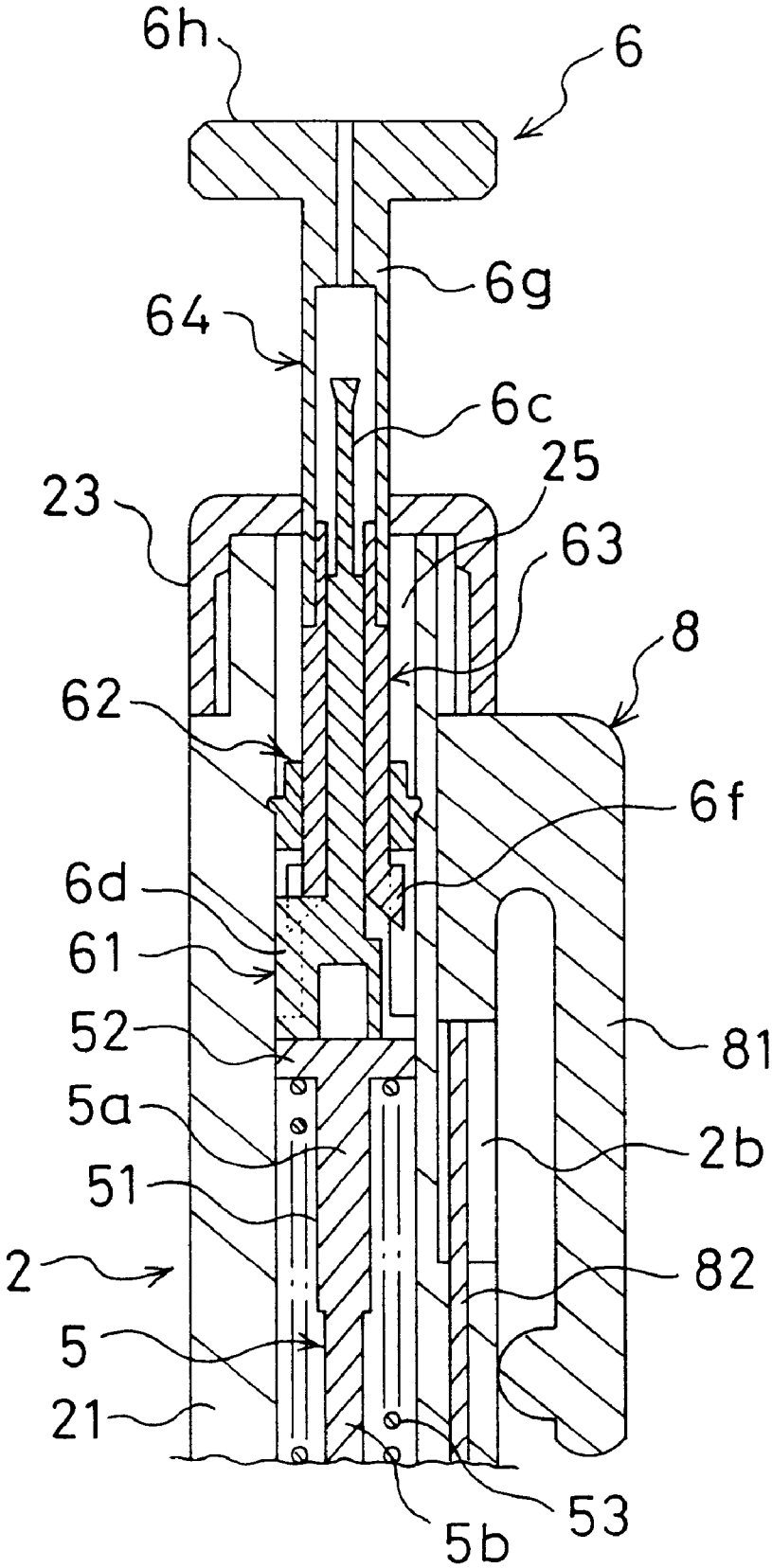
FIG. 4 is an enlarged vertical cross section showing the top side portion of the pipette.
Figure 5:
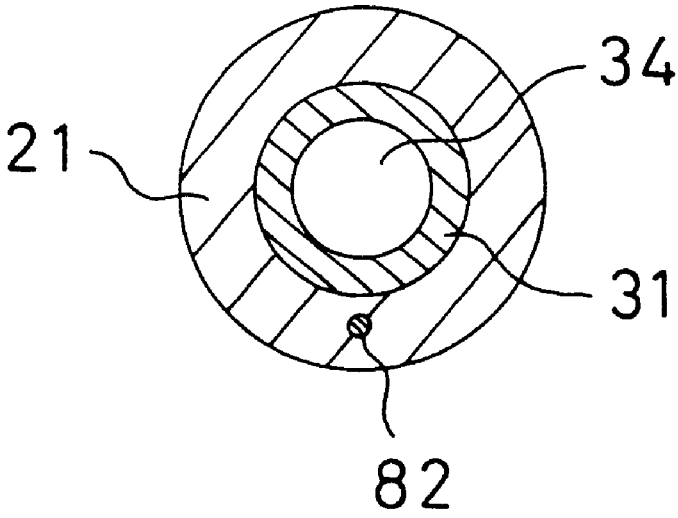
FIG. 5 is a cross section taken on line V—V of FIG. 2.

The pipette 1 of FIG. 2 is in a state before sucking a liquid sample. In this state, the stroking member 11 is pushed into contact with the flange 32 of the cylinder 3, the first piston 4 protrudes from the cylinder body 31, and the second piston 5 protrudes from the first piston 4. Both the pistons 4, 5 are in the maximum protruding state. Accordingly, the first and second suction chambers 34 and 43 each have a maximum capacity.

In the above state, the extension nozzle 7 is fitted on the nozzle part 33 so as to be attached to the cylinder 3. The body part 21 of the casing 2 is held with one hand, and the push part 6*h* of the operating lever 6 is then pushed with a thumb of the hand to push the knocking cover 64 downward. The downward movement of the knocking cover 64 moves the knocking member 63 downward so that the slide parts 6*d*, 6*d*, . . . in contact with the cams 6*f*, 6*f*, . . . are pushed down. Thus, the rotor 61 is moved downward.

When the rotor moves downward, the second piton 5 is pushed down. At this time, since the second spring 53 is set to have less resiliency than the first spring 44, which is a feature of the present invention, only the second spring 53 is first compressed so that the piston body 51 of the second piston 5 is inserted into the second suction chamber 43. As a result, the second suction chamber 43 is reduced in capacity.

When the knocking cover 64 is further pushed down, the slide parts 6*d*, 6*d*, . . . of the rotor 61 are moved out of the slide grooves 6*a*, 6*a*, . . . of the guide member 62. The slide parts 6*d*, 6*d*, . . . moved out of the slide grooves 6*a*, 6*a*, . . . slide on the cam surfaces of the cams 6*f*, 6*f*, . . . so that the rotor 61 slightly rotates. As a result, the top surfaces of the slide parts 6*d*, 6*d*, . . . are brought into contact with the bottom surfaces of the strips 6*b*, 6*b*, . . . of the guide member 62. When the rotor 61 rotates, the slide parts 6*d*, 6*d*, . . . meet the adjacent cams 6*f*, 6*f*, . . . , respectively, to generate knocking sounds.

Figure 9:
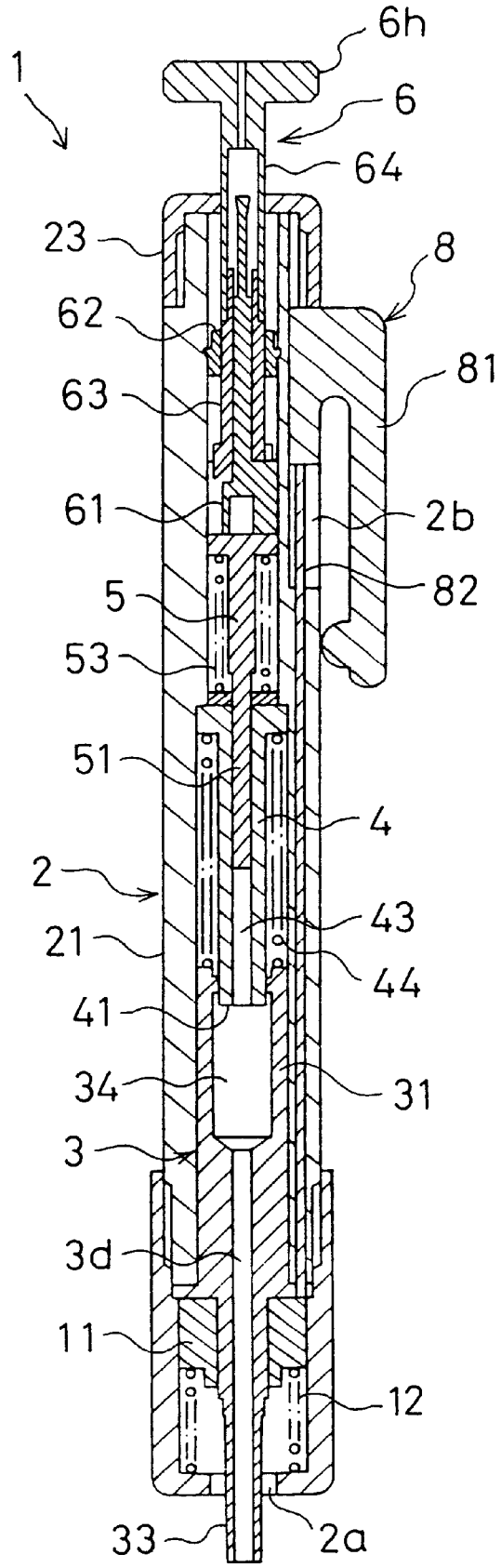
FIG. 9 is a vertical cross section showing the pipette under operation at a small suction position.

The position of the rotor 61 after rotation is shown in FIG. 9. In this state, the end surface of the large-diameter part 5*a* of the piston body 51 of the second piston 5 comes close to the flange 42 of the first piston 4 through the holding member 15. In other words, the small-diameter part 5*b* of the second piston 5 is largely inserted into the second suction chamber 43, so that the second piston 5 is set in the small suction position for sampling a small amount of liquid. More specifically, when the above-mentioned knocking sounds occur, the second piston 5 comes to the small suction position. The capacity in the small suction position is set at a sampling amount of, for example, 15 μl.

When the knocking cover 64 is still further pushed down, the shaft part 6*e* of the knocking member 63 comes into contact with the slide parts 6*d*, 6*d*, . . . and in this state the rotor 61 is further moved downward. Thus, the large-diameter part 5*a* of the second piston 5 meets the first piston 4 and pushes it downward to compress the first spring 44, so that the piston body 41 of the first piston 4 is inserted into the first suction chamber 34. As a result, the capacity of the first suction chamber 34 is reduced.

Figure 10:
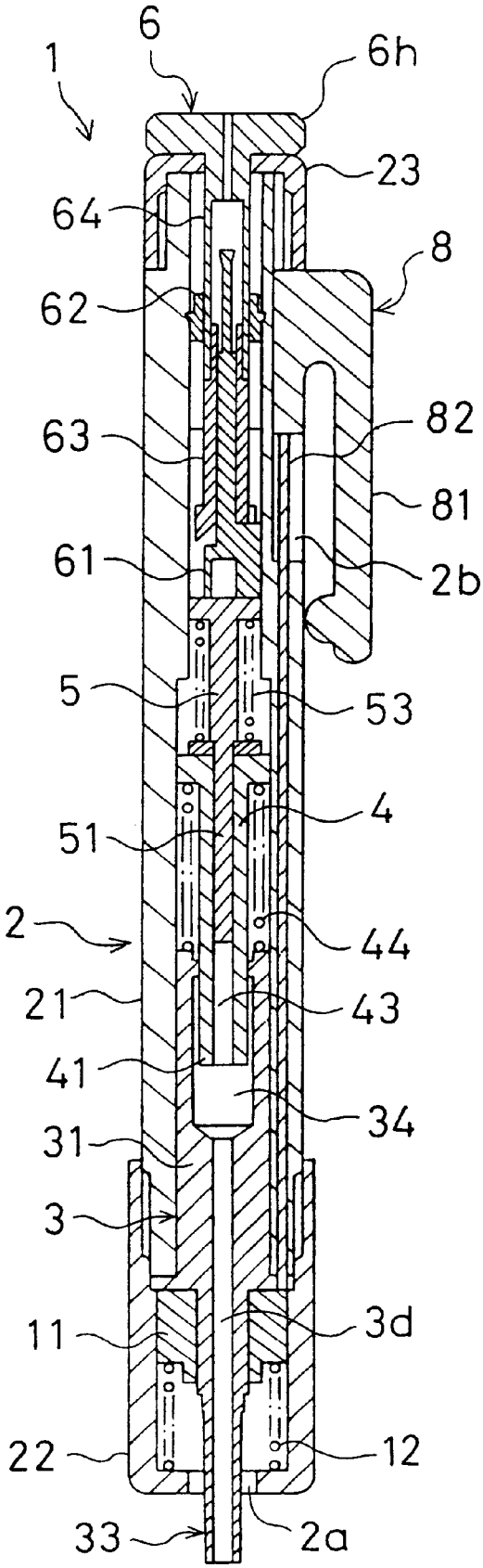
FIG. 10 is a vertical cross section showing the pipette under operation at a large suction position.

When the knocking cover 64 is pushed down to the deepest position, the pipette 1 comes into the state shown in FIG. 10, i.e., the state that the piston body 41 of the first piston 4 is most inserted into the first suction chamber 34. In detail, the first piston 4 is most inserted into the first suction chamber 34 in the state that the second piston 5 is most inserted into the second suction chamber 43, so that the first piston 4 is set in the large suction position for sampling a large amount of liquid. The capacity in the large suction position is set at a sampling amount of, for example, 500 μl.

When the push of the knocking cover 64 is eliminated, the first and second pistons 4 and 5 protrude by the resiliency of the first and second springs 44 and 53 to come back into the initial state of FIG. 2.

Detailed description will be made next about a selection between a large amount of sampling and a small amount of sampling in the above-mentioned pipette 1.

For example, when urine is examined in a physical checkup or the like, picked urine is first centrifuged, the supernatant fluid is removed and 200 μl of liquid is sampled. For this purpose, the pipette 1 is first put into the large suction position that the knocking cover 64 is pushed down at the maximum (See FIG. 10). In this state, the extension nozzle 7 is put in a liquid in a vessel for sample picking, and the knocking cover 64 is then moved backward until the amount of liquid in the vessel reaches 200 μl and is further moved backward to suck the supernatant fluid into the first suction chamber 34 and so on. Then, the supernatant fluid is removed.

Thereafter, 200 μl of liquid sample and the residue are mixed and from the mixture, 15 μl of liquid sample for urine precipitation test is picked up. For this purpose, the pipette 1 is put into the small suction position that the knocking cover 64 is slightly pushed down (See FIG. 9). In this state, the extension nozzle 7 is put in the liquid in the vessel for sample picking, and the knocking cover 64 is then moved backward to suck a liquid sample into the first suction chamber 34, thereby picking up the liquid sample for urine precipitation test.

When the extension nozzle 7 is detached, the clip 81 is pushed down to move the detaching pin 82 downward so that the stroking member 11 moves downward. When the stroking member 11 moves downward, the bottom end thereof meets the projection 73 of the extension nozzle 7 to detach the extension nozzle 7 from the nozzle part 33, though the case is not shown.

Effects of the Invention

According to the present embodiment as mentioned so far, since the first and second pistons 4 and 5 are reciprocatably two-deep fitted into the cylinder 3, selection can be made between a large amount of sampling and a small amount of sampling. As a result, the pipette of the present embodiment extends the range of applications as compared with the conventional pipette whose sampling amount is limited to a fixed amount. In particular, when a large number of samples are tested, a necessary amount of sampling can be readily made, which achieves prompt test execution.

Further, since the pipette of the present embodiment can simplify the structure and reduce the number of parts as compared with the conventional pipette of the capacity-variable type whose sampling amount is arbitrarily set, this reduces the manufacturing cost.

Furthermore, selection between a small amount of sampling and a large amount of sampling can be made with one hand, i.e., at the push of the push part 6*h* by a thumb. As a result, operation can be simplified thereby speeding the execution of various kinds of tests.

In addition, the extension nozzle 7 can be detached through the operation of the clip 81 alone. As a result, samples are avoided from touch with hand, which enables the test or the like to be executed in a prompt and considerably sanitary manner.

Modifications

Figure 11:
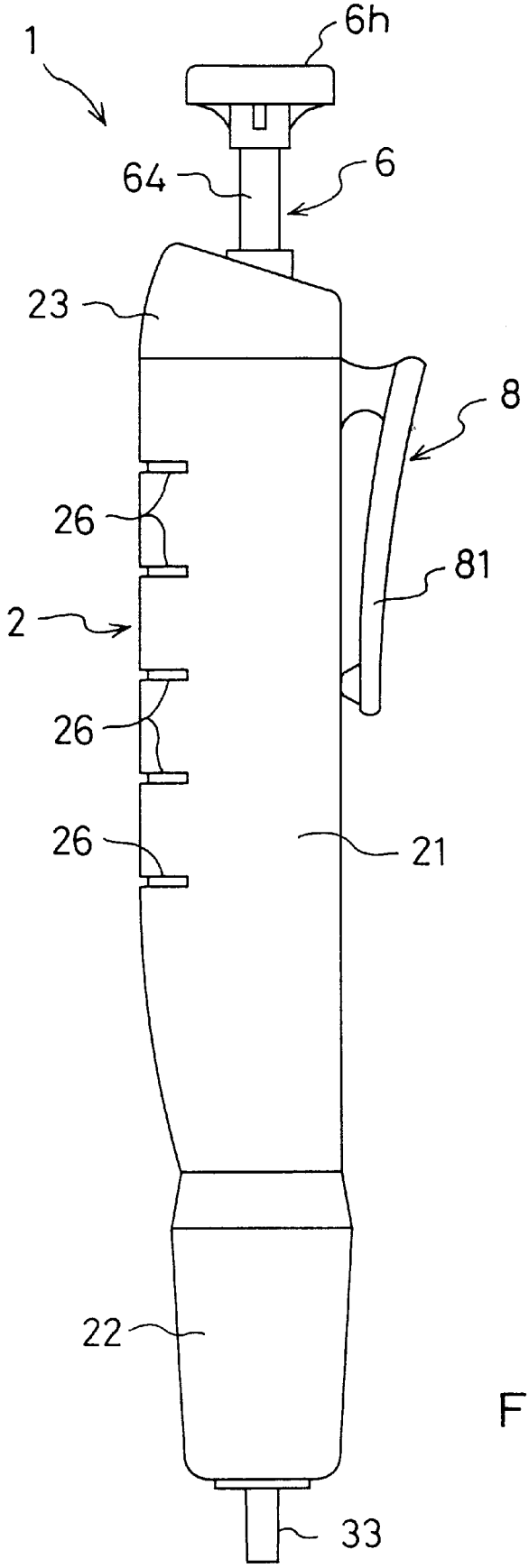
FIG. 11 is a front view showing a moderation of the pipette.
Figure 12:
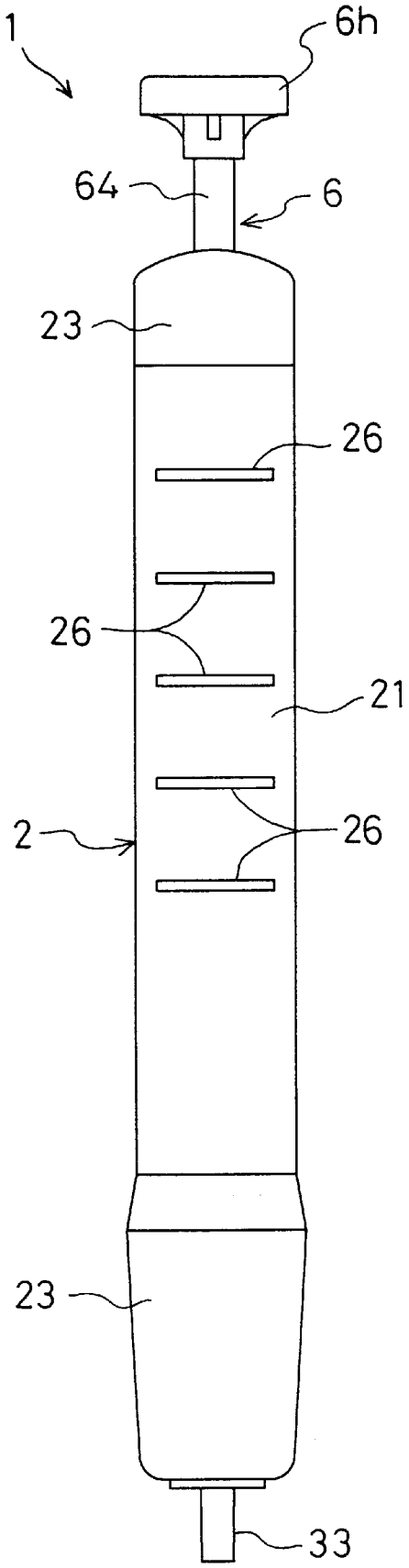
FIG. 12 is a side view showing the pipette of FIG. 11.

FIGS. 11 and 12 show a modification of the present embodiment. In the modification, the body part 21 of the casing 2 is formed so as to have an approximate oval form in section. The body part 21 has a plurality of lateral grooves 26 for slip protection formed on the surface opposite to the clip 81. The body part 21 having the oval sectional form can be held with a palm and fingers with ease and reliability. Further, the lateral grooves 26 prevent a slip of the body part 21. In addition, since the clip 81 is formed so as to be inclined on the body part 21 side and reduce its amount of projection as it comes close to the tip end, this makes the body part 21 readily grasped. Other internal structures such as the cylinder 3 are the same as in the embodiment shown in FIGS. 1 to 10.

In the embodiment shown in FIGS. 1 to 10, a knocking mechanism is employed for the operating lever 6. In the first solution of the present invention, however, the operating lever may be composed so as to simply push the first and second pistons 4 and 5.

The first spring 44, the second spring 53 and the compression spring 12 are not limited to coil springs shown in the above embodiment. For those springs, various kinds of resilient members such as a leaf spring and a piece of rubber are applicable.

In the first and second solutions of the present invention, a detaching mechanism for detaching the extension nozzle 7 may be dispensed with.

It is a matter of course that the present invention is not limited to the above-mentioned embodiment and the modifications.

What is claimed is:

1. A pipette comprising:

a cylindrical casing;

a cylinder formed at an inner tip end of said cylindrical casing;

a first suction chamber which is formed in said cylinder and is open on an inward end surface of the cylinder;

a nozzle part which is formed at an outward end of the cylinder t o ext end to the outside of the casing and has a suction passage in communication with the first suction chamber;

a first piston which is reciprocatably inserted into the first suction chamber;

a second suction chamber which is formed in said first piston and is open on both end surfaces of the first piston;

a second piston which is reciprocatably inserted into the second suction chamber, said second piston comprising a small-diameter part which is insertable into said second suction chamber and a large-diameter part which is engagable with said first piston to push said first piston;

a first resilient member which pushes said first piston in a direction of protruding from said cylinder;

a second resilient member which pushes said second piston in a direction of protruding from said first piston, said second resilient member having less resiliency than said first resilient member; and an operating lever which is provided in the casing comes into contact at an inward end thereof with a top surface of the second piston, and operates the first and second pistons to switch between a small suction position where the second piston is embedded in the first piston and a large suction position where the first and second pistons are embedded in the cylinder and the first piston, respectively.

2. A pipette comprising:

a cylindrical casing;

a cylinder formed at an inner tip end of said cylindrical casing;

a first suction chamber which is formed in said cylinder and is open on an inward end surface of said cylinder;

a nozzle part which is formed at an outward end of said cylinder to extend to the outside of the casing and has a suction passage in communication with said first suction chamber;

a first piston which is reciprocatably inserted into said first suction chamber;

a second suction chamber which is formed in said first piston and is open on both end surfaces of said first piston;

a second piston which is reciprocatably inserted into said second suction chamber;

a first resilient member which pushes said first piston in a direction of protruding from said cylinder, said first resilient member surrounding said second suction chamber;

a second resilient member which pushes said second piston in a direction of protruding from said first piston, said second resilient member having less resiliency than said first resilient member; and an operating lever which is provided in the casing, comes into contact at an inward end thereof with the top surface of said second piston, and operates said first and second pistons to switch between a small suction position where said second piston is embedded in said first piston and a large suction position where said first and second pistons are embedded in said cylinder and said first piston, respectively.

3. A pipette according to claim 4, wherein said second piston comprises a small-diameter part to be inserted into said second suction chamber and a large-diameter part which is engaged with said first piston and pushes said first piston.

4. A pipette according to claim 1, 2 or 3, wherein the operating lever includes:

a rotor which comes into contact with the top surface of the second piston and has a plurality of slide parts extending along the axis of the casing;

a guide member which is placed in the top part of the casing in a manner coaxial with the rotor and has a plurality of slide grooves for allowing entry and exit of the slide parts;

a knocking member positioned coaxially with the rotor, said knocking member having a plurality of cams which are each located in the corresponding slide groove and are each capable of contact with the end of the corresponding slide part; and a knocking cover which is formed in a coaxial and continuous manner with the knocking member, has the integrally-formed push part and moves the rotor through the cams in the axial direction of the casing, and the small suction position is set in a position where the slide parts are moved out of the slide grooves.

5. A pipette according to claim 1, 2 or 3, wherein an extension nozzle is detachably attached to the tip end of the nozzle part and an annular stroking member is axially movably provided on the nozzle part in a manner capable of meeting a base end of the extension nozzle, a resilient member for pushing the stroking member in a direction of locating away from the tip end of the nozzle part is interposed between the stroking member and a tip-end cap of the casing, and detaching means for moving the stroking member to detach the extension nozzle from the nozzle part is provided.

* * * * *